US009865948B2

(12) United States Patent
Phillips et al.

(10) Patent No.: US 9,865,948 B2
(45) Date of Patent: Jan. 9, 2018

(54) PLUG CONNECTOR HAVING A GUIDE FRAME

(71) Applicant: Tyco Electronics Corporation, Berwyn, PA (US)

(72) Inventors: Michael John Phillips, Camp Hill, PA (US); Randall Robert Henry, Harrisburg, PA (US); Linda Ellen Shields, Camp Hill, PA (US); Thomas Taake de Boer, Hummelstown, PA (US); Michael David Herring, Apex, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 97 days.

(21) Appl. No.: 14/537,959

(22) Filed: Nov. 11, 2014

(65) Prior Publication Data

US 2016/0134040 A1 May 12, 2016

(51) Int. Cl.

| | |
|---|---|
| ***H01R 13/64*** | (2006.01) |
| ***H01R 12/72*** | (2011.01) |
| ***H01R 12/70*** | (2011.01) |
| *H01R 107/00* | (2006.01) |
| *H01R 24/62* | (2011.01) |

(52) U.S. Cl.
CPC ..... *H01R 12/721* (2013.01); *H01R 12/7005* (2013.01); *H01R 12/722* (2013.01); *H01R 24/62* (2013.01); *H01R 2107/00* (2013.01)

(58) Field of Classification Search
CPC .... H01R 24/60; H01R 23/7073; H01R 23/02; H01R 12/721; H01R 12/722; H01R 12/7005
USPC ..... 439/374, 377, 660, 951, 76.1
See application file for complete search history.

(56) References Cited

U.S. PATENT DOCUMENTS

| | | | | |
|---|---|---|---|---|
| 4,298,237 | A * | 11/1981 | Griffith | H01R 12/82 439/60 |
| 5,627,726 | A * | 5/1997 | David | G09F 3/10 361/679.32 |
| 6,217,352 | B1 * | 4/2001 | Oliphant | H01R 24/62 439/131 |
| 6,343,020 | B1 * | 1/2002 | Lin | G11C 5/04 361/753 |
| 6,362,966 | B1 * | 3/2002 | Ali | G11C 5/00 174/252 |
| 6,439,919 | B1 * | 8/2002 | Yasufuku | H05K 1/117 439/377 |

(Continued)

*Primary Examiner* — Briggitte R Hammond
*Assistant Examiner* — Milagros Jeancharles

(57) ABSTRACT

A plug connector includes a circuit card and a guide frame mounted to the circuit card. The circuit card is held by a housing. The circuit card includes a front edge and opposing outer edges. The circuit card defines a datum hole in a first surface. The circuit card further includes a set of contact pads along the first surface proximate to the front edge. The contact pads are registered relative to the datum hole. The guide frame has a base that has a post. The guide frame includes a frame member that extends from the base. An outer wall of the frame member is registered relative to the post. The post is received in the datum hole of the circuit card such that the outer wall of the frame member is registered relative to the contact pads, independent of locations of the outer edges of the circuit card.

21 Claims, 4 Drawing Sheets

(56) References Cited

U.S. PATENT DOCUMENTS

| | | | | |
|---|---|---|---|---|
| 6,556,446 | B1 * | 4/2003 | Hwang | G02B 6/4201 361/728 |
| 7,059,913 | B1 * | 6/2006 | Chen | H01R 31/06 439/638 |
| 7,175,444 | B2 * | 2/2007 | Lang | H01R 43/00 439/76.1 |
| 7,247,057 | B2 * | 7/2007 | Matsuo | H05K 1/117 439/660 |
| 7,601,010 | B1 * | 10/2009 | Wu | H01R 12/62 439/466 |
| 7,648,372 | B2 * | 1/2010 | Wu | H01R 13/516 439/41 |
| 7,798,821 | B2 * | 9/2010 | Liu | H01R 9/034 439/459 |
| 7,997,909 | B2 * | 8/2011 | Xu | H01R 13/6658 439/607.57 |
| 8,144,482 | B2 * | 3/2012 | Sato | H05K 1/144 361/794 |
| 8,174,835 | B2 * | 5/2012 | Kim | G06F 1/185 361/679.31 |
| 2006/0134961 | A1 * | 6/2006 | Regnier | H01R 13/6335 439/331 |
| 2006/0189180 | A1 * | 8/2006 | Lang | H01R 43/00 439/76.1 |
| 2007/0253174 | A1 * | 11/2007 | Gu | H05K 5/0269 361/737 |

* cited by examiner

PLUG CONNECTOR HAVING A GUIDE FRAME

BACKGROUND OF THE INVENTION

The subject matter herein relates generally to plug connectors that have contact pads on a circuit board.

Some electrical connectors include a circuit board that has multiple contact pads that are configured to electrically engage mating contacts of a mating connector. Modern circuit board manufacturing processes are able to produce groups of contact pads separated by a fine pitch in order to increase the density of electrical connections per area of the circuit board. The contact pads may be accurately positioned pad-to-pad, such that the dimensions of the contact pads and the pitch between adjacent contact pads are kept constant and precise. However, often the groups of contact pads are not accurately positioned across a width of the circuit board and/or relative to edges of the circuit board. This shortcoming may cause the contact pads to misalign with the mating contacts of the mating connector because in many connector systems the side edges of the circuit board are used to guide and locate the mating interface of the electrical connector relative to the mating interface of the mating connector. For example, as the circuit board is inserted into a slot of the mating connector, the side edges of the circuit board (or components on the side edges) may engage inner walls of the mating connector that define the slot in order to guide the circuit board into the slot. If the contact pads on the circuit board are not aligned accurately relative to the side edges of the board, the contact pads may not align correctly with the corresponding mating contacts, which is detrimental to the electrical performance of the connector system. Considering that some contact pads are only 0.4 millimeters (mm) wide and are separated by a 0.5 mm pitch, if the side edges are incorrectly positioned relative to the contact pads by a fraction of a millimeter, the contact pads may entirely miss the appropriate corresponding mating contacts of the mating connector. In addition, some circuit boards include groups of contact pads on opposing sides of the circuit board. If a first group of contact pads on a first side of the circuit board is slightly misaligned relative to the side edges of the circuit board, flipping the circuit board over to etch or otherwise produce a second group of contact pads may exacerbate the error.

Known techniques used to tightly and accurately control the locations of the contact pads relative to the side edges of the circuit board include using secondary machinery to shape the edges of the circuit board and also encasing the circuit board in a separate molded enclosure. But, both techniques are expensive and may be complicated. A need remains for a connector that includes a circuit board with contact pads that align accurately with mating contacts upon being received in a mating connector.

BRIEF DESCRIPTION OF THE INVENTION

In an embodiment, a plug connector includes a circuit card and a guide frame. The circuit card is held by a housing. The circuit card has a first surface and an opposite second surface. The circuit card includes a front edge and opposing outer edges. The circuit card defines at least one datum hole in the first surface. The circuit card further includes a set of contact pads along the first surface proximate to the front edge. The contact pads are registered relative to the at least one datum hole. The guide frame is mounted to the circuit card. The guide frame has a base that has at least one post extending from a side thereof. The guide frame includes a frame member that extends from the base. An outer wall of the frame member is registered relative to the at least one post. The at least one post is received in the at least one datum hole of the circuit card such that the outer wall of the frame member is registered relative to the contact pads, independent of locations of the outer edges of the circuit card.

In another embodiment, a connector system includes a plug connector and a receptacle connector. The plug connector includes a circuit card held by a housing and a guide frame mounted to the circuit card. The circuit card includes a front edge and opposing outer edges. The circuit card defines at least one datum hole through a first surface of the circuit card. The circuit card further includes a set of contact pads along the first surface proximate to the front edge. The contact pads are registered relative to the at least one datum hole. The guide frame has a base that includes at least one post. The guide frame further includes a frame member that extends from the base. An outer wall of the frame member is registered relative to the at least one post. The at least one post is received in the at least one datum hole of the circuit card such that the outer wall of the frame member is registered relative to the contact pads. The receptacle connector has a receptacle housing that defines a slot at a mating end thereof. The receptacle connector holds multiple receptacle contacts along at least one of a first side wall or a second side wall. The slot is defined between the first and second side walls and between first and second end walls. The first and second end walls extend between the first and second side walls. When the plug connector is mated to the receptacle connector, the outer wall of the frame member of the guide frame is configured to engage the first end wall or the second end wall of the slot to guide the set of contact pads on the circuit card into alignment with the corresponding receptacle contacts of the receptacle connector.

DETAILED DESCRIPTION OF THE INVENTION

Figure 1:
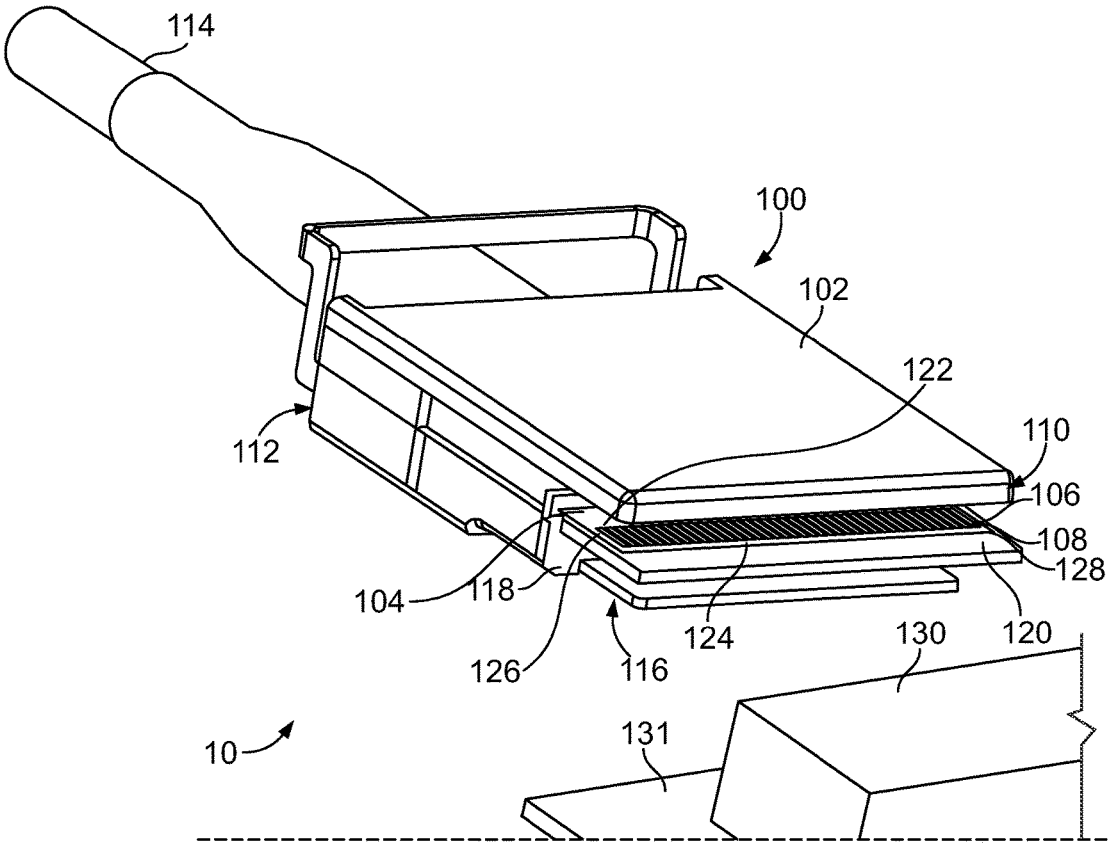
FIG. 1 is a perspective view of a connector system according to an embodiment.

FIG. 1 is a perspective view of a connector system 10 according to an embodiment. The connector system 10 includes an electrical connector 100 and a mating connector 130. The mating connector 130 is configured to mate to the electrical connector 100 to form an electrical signal path across the connectors 100, 130. The mating connector 130 is mounted to a circuit board 131. The electrical connector 100 includes a housing 102. The housing 102 holds a circuit card 104. The circuit card 104 includes at least one set 106 of contact pads 108. In the illustrated embodiment, the electrical connector 100 is a cable-terminated plug that is terminated to a cable 114 and is configured to be pluggable into the mating connector 130, which is a receptacle. As used herein, the electrical connector 100 may be referred to as plug connector 100, and the mating connector 130 may be referred to as receptacle connector 130. In alternative embodiments, the electrical connector 100 may be terminated to a circuit board instead of the cable 114.

The housing 102 has a front end 110 and a rear end 112, in the illustrated embodiment, the cable 114 terminates to and extends from the rear end 112. The front end 110 defines a mating interface 116 that is configured to engage and interface with the mating connector 130. As used herein, relative or spatial terms such as "front," "rear," "first," "second," "left," and "right" are only used to distinguish the referenced elements and do not necessarily require particular positions or orientations in the plug connector 100, the mating connector 130, and/or the connector system 10 in general relative to gravity or relative to the surrounding environment.

The circuit card 104 extends from a front wall 118 of the housing 102 at the mating interface 116. In an exemplary embodiment, the portion of the circuit card 104 extending from the housing 102 is at least partially surrounded by a guide frame 120. The guide frame 120 may be mounted to the circuit card 104. For example, the guide frame 120 may mount to the circuit card 104 within the housing 102. The guide frame 120 may be configured to guide the circuit card 104 into a slot of a mating connector. The guidance from the guide frame 120 may allow the contact pads 108 on the circuit card 104 to align accurately with the appropriate corresponding mating contacts of the mating connector 130.

Figure 5:
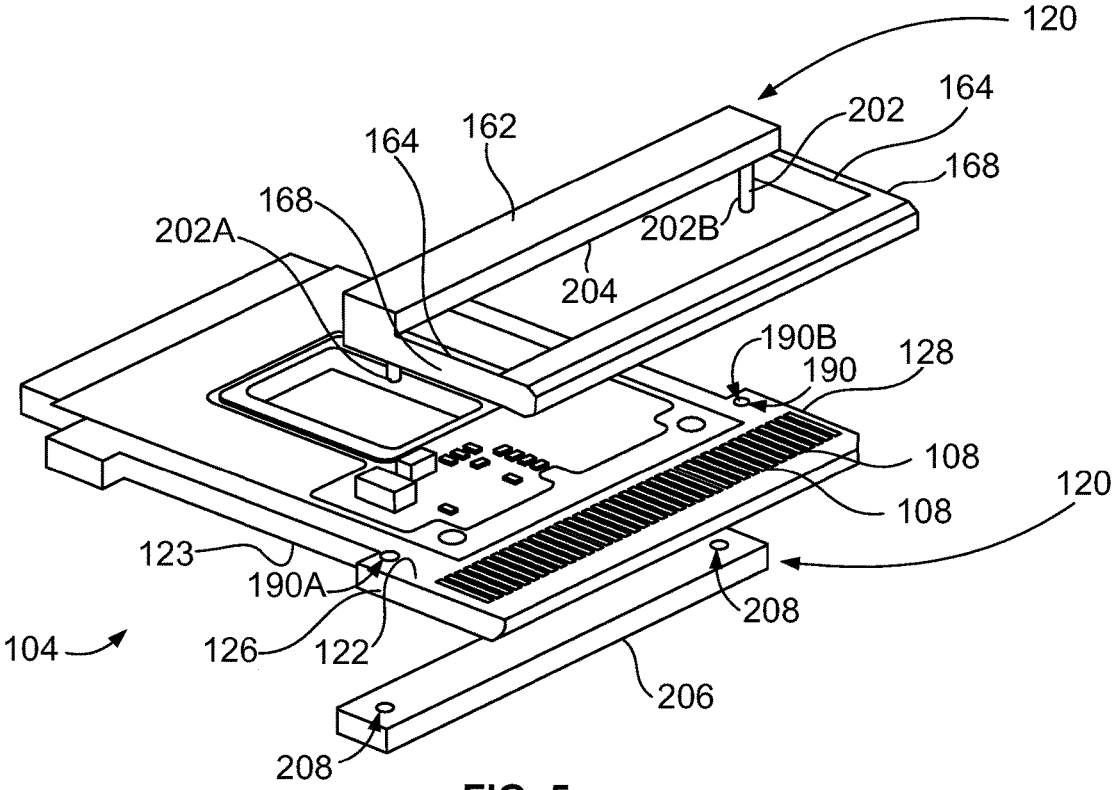
FIG. 5 is an exploded view of the circuit card and a guide frame of the electrical connector according to an embodiment.

The circuit card 104 has a first surface 122 and an opposite second surface 123 (shown in FIG. 5). The set 106 of contact pads 108 are disposed along the first surface 122. For example, although not shown in FIG. 1, the set 106 of contact pads 108 may be a first set of contact pads, and the circuit card 104 optionally may include a second set of contact pads (not shown) disposed along the second surface 123. The circuit card 104 includes a front edge 124 and opposing outer edges, referred to herein as a first outer edge 126 and a second outer edge 128. The contact pads 108 of the first set 106 (and optional second set) may be located proximate to the front edge 124. In the illustrated embodiment, the set 106 of contact pads 108 may extend across a width of the circuit card 104 between the first and second outer edges 126, 128. For example, the contact pads 108 may be positioned side-by-side in a row across the width of the circuit card 104. Adjacent contact pads 108 may be separated from each other by a contact spacing. In an embodiment, the contact pads 108 may be fine pitch contact pads that have a pitch, measured between the midpoints of adjacent contact pads 108, of less than 1 mm, and optionally less than 0.6 mm. In addition, the contact pads 108 may have an individual width of less than 1 mm, such as less than 0.5 mm. Also, the contact spacing, dependent on the pitch and the width of the contact pads, may be less than 0.5 mm, such as less than or equal to 0.2 mm. For example, the contact pads 108 optionally may have a pitch of 0.5 mm, individual widths of 0.3 mm, and contact spacings of 0.2 mm.

Figure 2:
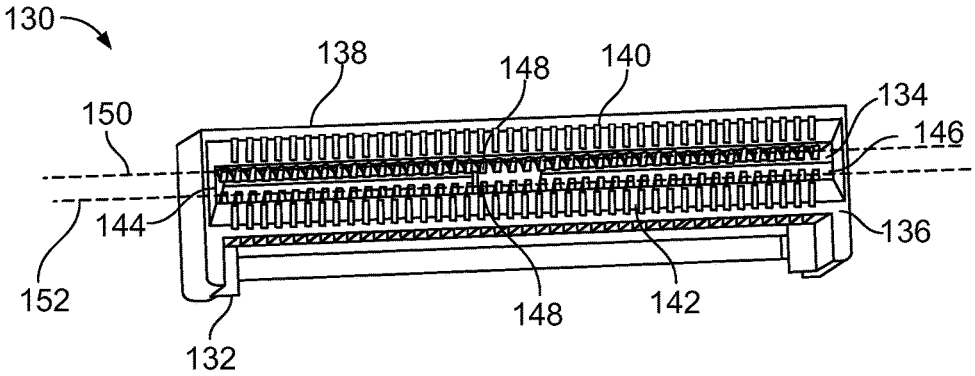
FIG. 2 is a perspective view of a mating connector of the connector system according to an embodiment.

Referring now also to FIG. 2, FIG. 2 is a perspective view of the mating electrical connector 130 according to an embodiment. The mating connector 130 in the illustrated embodiment may be a right angle board-mountable receptacle connector. For example, the mating connector 130 may include a mounting end 132 that is configured to be mounted to the circuit board 131. The connector 130 is a right angle connector because the connector 130 defines a slot 134 in a mating end 136 that is generally orthogonal to the mounting surface at the mounting end 132. Alternatively, the mating connector 130 may be a vertical board-mount connector such that the mating end is generally opposite from and oriented parallel to the mounting end. In alternative embodiments, the connector 130 may be a cable-mount connector, or the like. The mating connector 130 is referred to herein as receptacle connector 130 because the slot 134 defines a socket that is configured to receive at least a portion of the plug connector 100 as the connectors 100, 130 are mated. For example, the portion of the circuit card 104 that includes the contact pads 108 is received in the slot 134 during a mating operation.

The receptacle connector 130 includes a receptacle housing 138 that defines the mating end 136 and the mounting end 132. The receptacle housing 138 includes a first side wall 140 and a second side wall 142 opposite to the first side wall 140. The side walls 140, 142 define the slot 134 therebetween. The receptacle housing 138 also includes a first end wall 144 and an opposite second end wall 146. The end walls 144, 146 extend between the side walls 140, 142 and also define the slot 134 therebetween. For example, the first side wall 140 may define an upper edge of the slot 134, the second side wall 142 defines a lower edge of the slot 134, the first end wall 144 defines a left edge of the slot 134, and the second end wall 146 defines a right edge of the slot 134. The receptacle connector 130 holds multiple mating or receptacle contacts 148 along the first side wall 140 and/or the second side wall 142. In the illustrated embodiment, a first row 150 of receptacle contacts 148 is held along the first side wall 140, and a second row 152 of receptacle contacts 148 is held along the second side wall 142. The receptacle contacts 148 may be deflectable beam-style contacts that extend at least partially into the slot 134.

During a mating operation, the receptacle contacts 148 may be configured to at least partially deflect upon the circuit card 104 entering the slot 134 and to apply a biasing force on the contact pads 108 to retain mechanical and electrical engagement with the corresponding contact pads 108. Depending on the relative orientation of the connectors 100, 130 during mating, the first set 106 of contact pads 108 of the plug connector 100 may be configured to align with and engage the first row 150 of receptacle contacts 148, and the second set of contact pads 108 may be configured to align with and engage the second row 152 of receptacle contacts 148. As the circuit card 104 enters the slot 134 of the receptacle connector 130, the guide frame 120 may engage the first end wall 144 and/or the second end wall 146. As the plug connector 100 is moved further in a mating direction towards the receptacle connector 130, the guide frame 120 slides against the first end wall 144 and/or second end wall 146. The end walls 144, 146 restrict lateral movement of the circuit card 104 within the slot 134, so the circuit card 104 is accurately positioned relative to the slot 134. The receptacle contacts 148 may be accurately located relative to the end walls 144, 146 of the slot 134. In an exemplary embodiment, the guide frame 120 of the plug connector 100 is accurately positioned relative to contact pads 108. Thus, transitively, the contact pads 108 are accurately positioned relative to the receptacle contacts 148 during the mating operation such that the contact pads 108 align with and properly engage the appropriate corresponding receptacle contacts 148. For example, contact pads 108 that convey power signals align with and engage receptacle contacts 148 that convey power signals, and contact pads 108 that convey data signals align with and engage receptacle contacts 148 that convey data signals.

Figure 3:
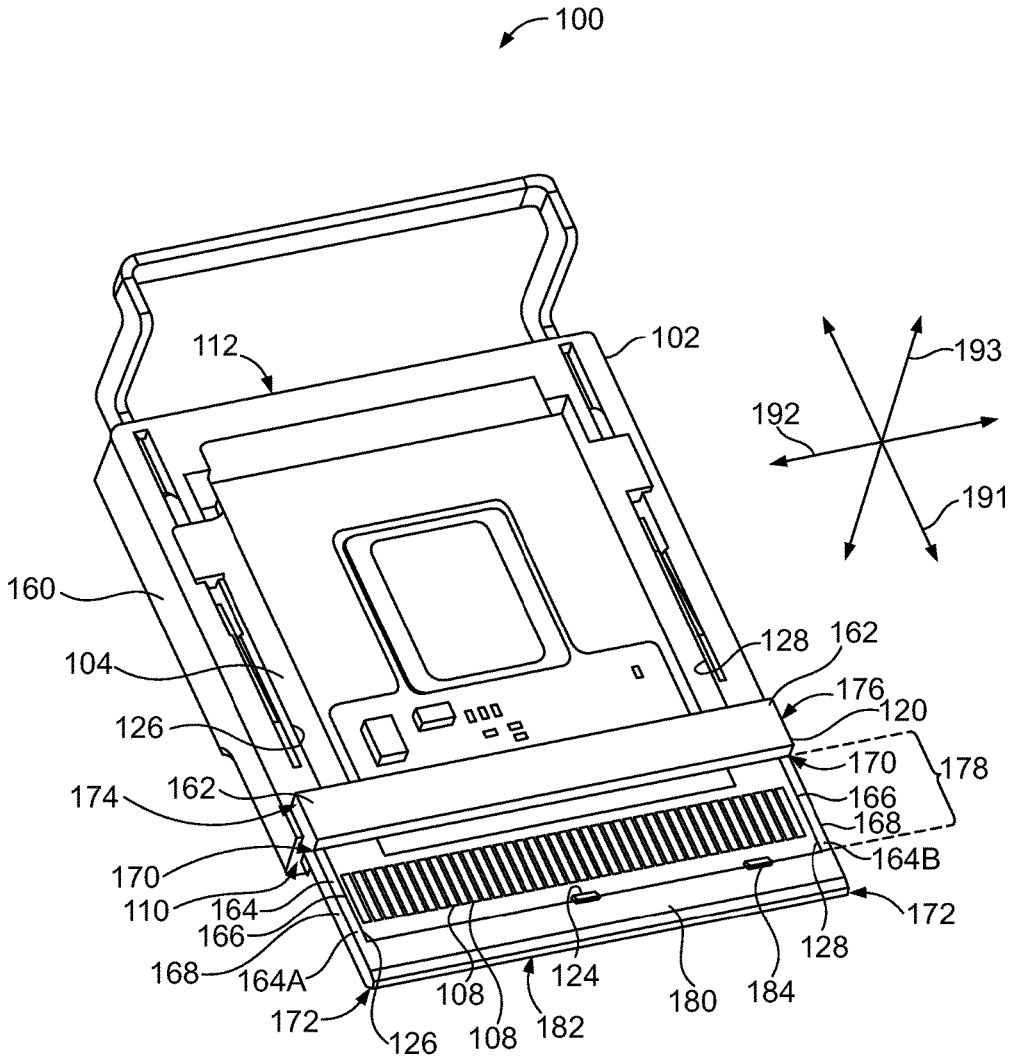
FIG. 3 is a perspective view of a portion of an electrical connector of the connector system according to an embodiment.

FIG. 3 is a perspective view of a portion of the plug electrical connector 100 according to an embodiment. The housing 102 may be a shell formed by coupling two half shells. In FIG. 3, only one half shell 160 of the two half shells is shown to better illustrate the circuit card 104 that is held within the housing 102. The cable 114 (shown in FIG. 1) extending from the rear end 112 of the housing 102 is also not shown in FIG. 3. Wires and/or optical fibers of the cable 114 terminate to the circuit card 104 within a cavity of the housing 102. The half shell 160 may have coupling features that complement features on the other half shell to allow for coupling therebetween. The half shell that is not depicted may include a cable opening at the terminating end to allow the cable 114 to extend from the housing 102. As shown in FIG. 3, the plug connector 100 is oriented with respect to a longitudinal or mating axis 191, a lateral axis 192, and a vertical or elevation axis 193. The axes 191-193 are mutually perpendicular. It is understood that the axes 191-193 are not required to have any particular orientation with respect to gravity. The housing 102 extends along the longitudinal axis 191 between the front end 110 and the rear end 112.

The guide frame 120 has a base 162 and a frame member 164 that extends from the base 162. The base extends laterally across a width of the circuit card 104 between the first and second outer edges 126, 128. The frame member 164 extends frontward (or forward) from the base 162 proximate to one of the first outer edge 126 or the second outer edge 128 of the circuit card 104. For example, the base 162 has a first end 174 that is proximate to the first outer edge 126 and a second end 176 that is proximate to the second outer edge 128. The frame member 164 may extend from the base 162 at or proximate to the first end 174 or the second end 176. The frame member 164 may extend parallel to the longitudinal axis 191 and laterally outside of the respective outer edge 126 or 128. For example, the frame member 164 includes an inner wall 166 that faces the respective outer edge 126 or 128 of the circuit card 104 and an opposite outer wall 168 that faces laterally outward away from the outer edge 126 or 128. The frame member 164 has a proximal end 170 at the base 162 (for example, where the frame member 164 couples to and/or extends from the base 162) and a distal end 172 away from the base 162. In an embodiment, the frame member 164 extends forward beyond the circuit card 104 such that the distal end 172 is located forward of the front edge 124 of the circuit card 104. Alternatively, the frame member 164 does not extend beyond the front edge 124 of the circuit card 104.

The base 162 of the guide frame 120 partially defines a mating segment 178 of the circuit card 104 that is configured to be received in a slot of a mating connector, such as the slot 134 (shown in FIG. 2) of the receptacle connector 130 (FIG. 2), during a mating operation. The mating segment 178 extends longitudinally between the base 162 and the front edge 124 of the circuit card 104. The contact pads 108 are disposed on the mating segment 178. The frame member 164 of the guide frame 120 extends proximate to the first outer edge 126 or the second outer edge 128 of the circuit card 104 along the mating segment 178. For example, the frame member 164 may border or frame the respective outer edge 126 or 128 along the mating segment 178. During the mating operation with the receptacle connector 130, the outer wall 168 of the frame member 164 is configured to engage one of the first end wall 144 (shown in FIG. 2) or the second end wall 146 (FIG. 2) of the slot 134, which guides the mating segment 178 of the circuit card 104 into the slot 134. The engagement between the outer wall 168 of the frame member 164 and the respective end wall 144 or 146 positions the contact pads 108 into proper and accurate alignment with the corresponding mating receptacle contacts 148 (shown in FIG. 2) of the receptacle connector 130.

In the illustrated embodiment, the frame member 164 is a first frame member 164A that extends from the base 162 at or at least proximate to the first end 174 of the base 162. The guide frame 120 further includes a second frame member 164B that extends from the base 162 at or at least proximate to the second end 176 of the base 162. The second frame member 164B may be identical to, or at least similar to, the first frame member 164A. The first and second frame members 164A, 164B may extend parallel to each other. The first frame member 164A extends along the first outer edge 126 of the circuit card 104, and the second frame member 164B extends along the second outer edge 128 of the circuit card 104. The outer walls 168 of the frame members 164A, 164B may be laterally outward of the outer edges 126, 128 of the circuit card 104 such that the outer edges 126, 128 are disposed between the outer walls 168 of the first and second frame members 164A, 164B.

In an embodiment, the distal ends 172 of the first and second frame members 164A, 164B are connected to each other via a ledge 180. The ledge 180 may extend forward beyond the front edge 124 of the circuit card 104. For example, the front edge 124 of the circuit card 104 may be rearward of at least part of the ledge 180, such that the ledge 180 defines a front end 182 of a mating interface of the plug connector 100. In the illustrated embodiment, the front edge 124 of the circuit card 104 is rearward of a rear edge 184 of the ledge 180. As the plug connector 100 is mated to the receptacle connector 130 (shown in FIG. 2), the ledge 180 may be received first in the slot 134 (FIG. 2) of the receptacle connector 130. The ledge 180 may provide vertical guidance for the circuit card 104 upon entering the slot 134. The ledge 180 may also be configured to engage a back wall (not shown) of the receptacle connector 130 upon reaching a pre-defined fully mated position to prevent further movement in the loading direction beyond the fully mated position.

Figure 4:
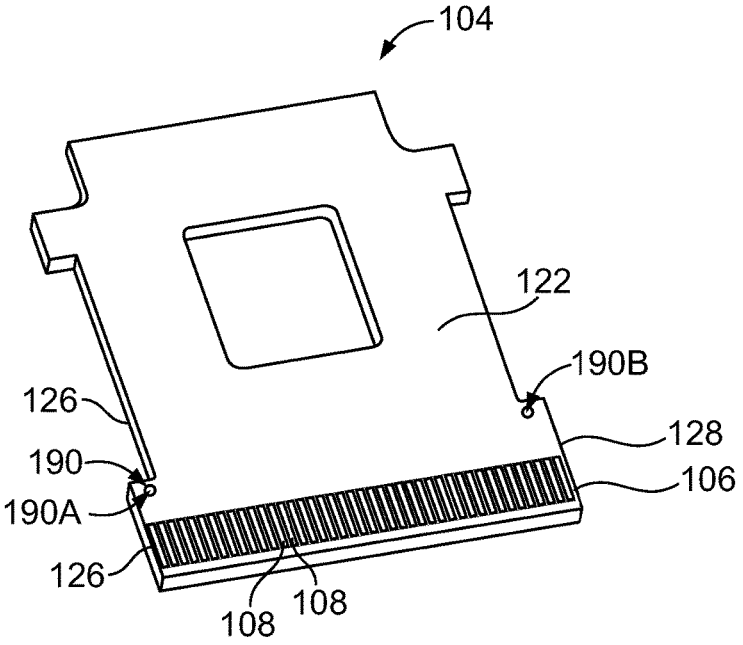
FIG. 4 is a perspective view of a circuit card of the electrical connector according to an embodiment.

FIG. 4 is a perspective view of the circuit card 104 of the plug electrical connector 100 (shown in FIG. 1) according to an embodiment. The first surface 122 of the circuit card 104 is shown, although the second surface 123 (shown in FIG. 5) may be identical to, or at least similar to, the first surface 122. The circuit card 104 may be a printed circuit board that includes one or more conductive metallic layers on a non-conductive substrate. For example, the contact pads 108 may be etched from a copper sheet and laminated onto a substrate. Alternatively, the set 106 of contact pads 108 may be a discrete component that is soldered to or otherwise fixed to the first surface 122 of the circuit card 104. Although not shown, the circuit card 104 may include additional sets of contact pads, additional electrical components (for example, capacitors and resistors), and the like.

The circuit card 104 defines at least one datum hole 190 in the first surface 122. The at least one datum hole 190 extends at least partially through a thickness of the circuit card 104 between the first surface 122 and the opposite second surface 123 (shown in FIG. 5). For example, the at least one datum hole 190 may extend fully through the circuit card 104 such that the at least one datum hole 190 has an opening at both the first surface 122 and the second surface 123. In the illustrated embodiment, the circuit card 104 defines a two datum holes 190. A first datum hole 190A is proximate to the first outer edge 126, and a second datum hole 190B is proximate to the second outer edge 128. In alternative embodiments, the circuit card 104 may include one datum hole 190 or more than two datum holes 190, and the datum hole(s) 190 may not be located near the outer edges 126, 128.

In an exemplary embodiment, the at least one datum hole 190 is used as a reference point when determining the locations of the contact pads 108. For example, during the manufacturing process when the contact pads 108 are etched in or applied to the circuit card 104, the locations of the contact pads 108 on the first surface 122 are determined based on the location of the at least one datum hole 190. Thus, the set 106 of contact pads 108 is registered relative to the at least one datum hole 190. As used herein, a first component or group of components being "registered relative to" a second component or group of components means that the first component or group is positioned, located, and/or oriented based on a position, location, and/or orientation of the second component or group. For example, an etching tool that etches the contact pads 108 may use the at least one datum hole 190 as one or more reference points when locating the proper placement of the tool on the circuit card 104 for each contact pad 108. Optionally, a second set of contact pads (not shown) on the second surface 123 (shown in FIG. 5) of the circuit card 104 are also registered relative to the at least one datum hole 190. As a result, the contact pads 108 on both the first surface 122 and the second surface 123 may both be positioned based on the same reference point(s). Thus, the contact pads 108 on the first surface 122 and the contact pads on the second surface 123 may be accurately positioned relative to each other.

In some known circuit boards, the contact pads are positioned on the respective board relative to outer edges of the circuit board. However, the outer edges of the circuit boards may not be precisely produced, so the outer edges may be at least partially rough (as opposed to straight) and/or oriented at an imprecise angle relative to each other or relative to a front edge. Thus, positioning contact pads relative to the edges of the circuit boards may result in the contact pads being misaligned with corresponding mating contacts of a mating connector. The problem is aggravated for high density fine pitch connectors that include a large number of small contacts placed close together. Thus, on the circuit card 104 of the plug connector 100 in an embodiment, the set 106 of contact pads 108 is registered relative to at least one datum hole 190 in the circuit card 104 instead of relative to the outer edges 126, 128. Registering the set 106 of contact pads 108 relative to the at least one datum hole 190 may result in more accurately and precisely located contact pads 108 relative to locations of the receptacle contacts 148 (shown in FIG. 2) of the receptacle connector 130 (FIG. 2).

FIG. 5 is an exploded view of the circuit card 104 and the guide frame 120 of the plug electrical connector 100 (shown in FIG. 1) according to an embodiment. The guide frame 120 includes at least one post 202. The at least one post 202 is configured to be received in a corresponding datum hole 190 of the circuit card 104 to position the guide frame 120 relative to the circuit card 104. In addition, the insertion of the at least one post 202 into the at least one datum hole 190 may be used to mount the guide frame 120 to the circuit card 104. In the illustrated embodiment, the at least one post 202 extends from a lower side 204 of the base 162. Alternatively, or in addition, the one or more posts 202 may extend from a different component of the guide frame 120, such as from a frame member 164. The frame member 164 extends from the base 162 perpendicular to the at least one post 202. For example, the frame member 164 may extend in a forward direction parallel to the longitudinal axis 191 (shown in FIG. 3), while the at least one post 202 extends in a downward direction parallel to the vertical axis 193 (FIG. 3). To mount the guide frame 120 to the circuit card 104, the guide frame 120 may be lowered onto the first surface 122 from above such that the at least one post 202 enters the corresponding at least one datum hole 190. The guide frame 120 in the illustrated embodiment includes a first post 202A and a second post 202B. The first post 202A is configured to be received in the first datum hole 190A, and the second post 202B is configured to be received in the second datum hole 190B. Optionally, although not shown in FIG. 5, the posts 202A, 202B and the datum holes 190A, 190B may be keyed (for example, located, shaped, angled, or the like) to allow for only a single relative orientation between the guide frame 120 and the circuit card 104 upon mounting.

In an embodiment, the outer wall 168 of the at least one frame member 164 of the guide frame 120 is registered relative to the at least one post 202. Thus, the location, orientation, and physical dimensions of the outer wall 168 relative to the at least one post 202 are accurately controlled during the manufacturing process that forms the guide frame 120. The guide frame 120 may be composed of a dielectric material or compound, such as plastic. In an embodiment, the guide frame 120 is formed by a molding process. The at least one frame member 164 and the at least one post 202 are formed integral to the base 162 during the molding process. Alternatively, the frame member(s) 164 and/or the post(s) 202 may be fixed to the base 162 after the molding process. Since the outer wall 168 of the at least one frame member 164 is registered relative to the at least one post 202, when each post 202 is received in the respective datum hole 190 of the circuit card 104, the outer wall 168 of each frame member 164 is transitively registered relative to the contact pads 108 (because the contact pads 108 are registered relative to the datum hole(s) 190). As a result, the outer wall 168 of each frame member 164 of the guide frame 120 is accurately located and positioned relative to the contact pads 108 of the circuit card 104. The outer wall 168 of each frame member 164 and the contact pads 108 are all located independently of locations and/or positions of the outer edges 126, 128 of the circuit card 104.

In the illustrated embodiment, the guide frame 120 additionally includes a retention plate 206. The retention plate 206 defines at least one retention hole 208 that is configured to receive the at least one post 202 of the guide frame 120. For example, the retention plate 206 may be located along the second surface 123 of the circuit card 104. In an embodiment, the at least one datum hole 190 extends fully through the circuit card 104, and the at least one post 202 is configured to extend through the at least datum hole 190 from the first surface 122 and protrude beyond the second surface 123. The portion of the post(s) 202 protruding from the second surface 123 is received in a corresponding retention hole 208, which couples the retention plate 206 to the base 162 of the guide frame 120. The coupling between the retention plate 206 and the base 162 via the at least one post 202 fixes the guide frame 120 to the circuit card 104. In alternative embodiments, instead of using a retention plate 206, the post(s) 202 of the guide frame 120 may be fixed in place in the datum hole(s) 190 due to an interference fit, an adhesive, and/or a fastener, such as a deflectable latch, a transverse pin, or the like.

Figure 6:
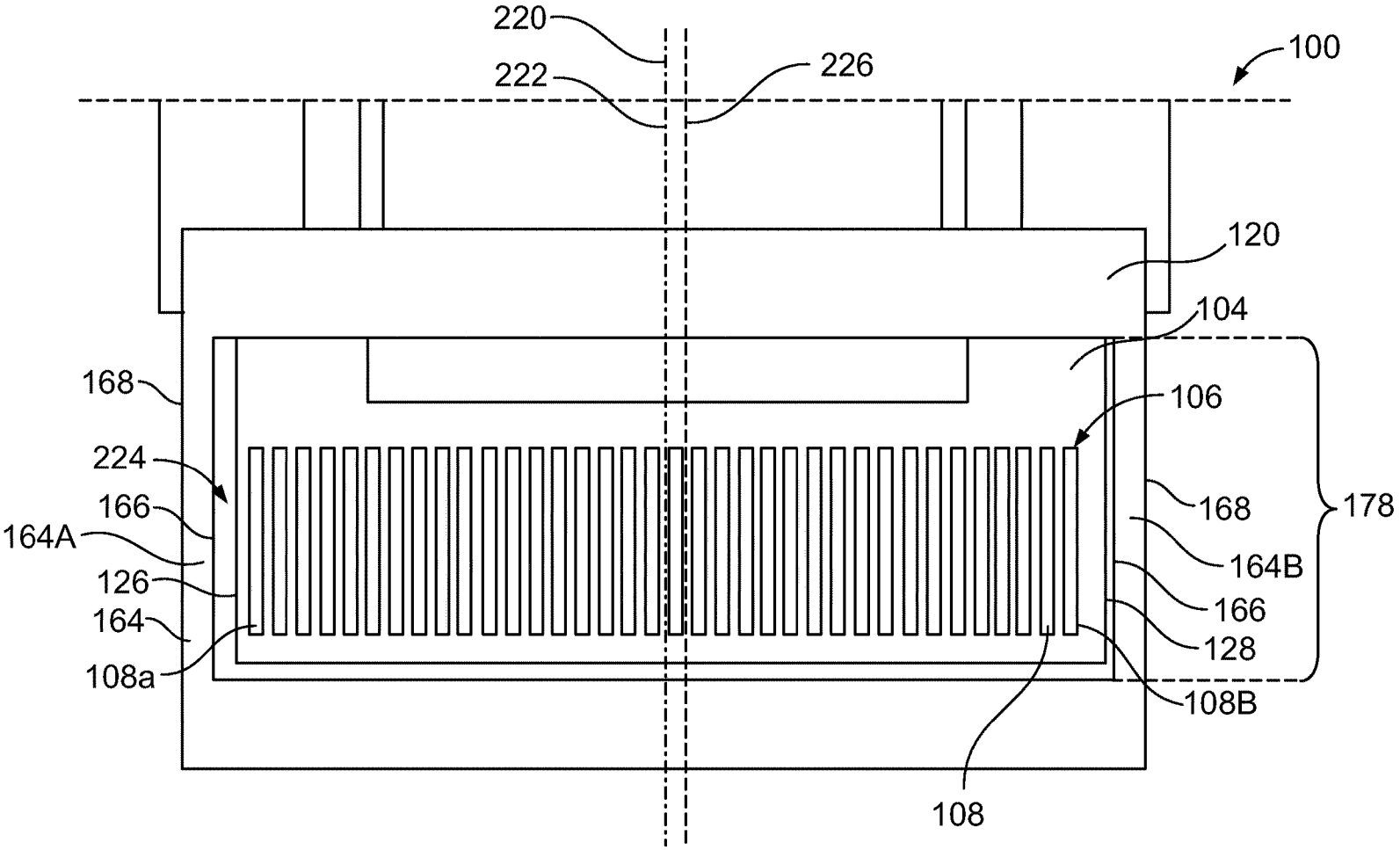
FIG. 6 is a top view of a portion of the electrical connector according to an embodiment.

FIG. 6 is a top view of a portion of the plug electrical connector 100 according to an embodiment. In an exemplary embodiment, the set 106 of contact pads 108 of the circuit card 104 are registered relative to the at least one datum hole 190 (shown in FIG. 4). In addition, the guide frame 120 is mounted to the circuit card 104 by inserting the at least one post 202 (shown in FIG. 5) into the corresponding datum hole(s) 190, such that the outer walls 168 of the frame members 164 are also positioned relative to the at least one datum hole 190. Since both the contact pads 108 and the guide frame 120 are positioned relative to the datum hole(s) 190, the contact pads 108 and the guide frame 120 are accurately positioned relative to each other. For example, the guide frame 120 defines a guide frame centerline 220 that is midway between the outer walls 168 of the frame members 164. The set 106 of contact pads 108 define a contact pad centerline 222 that is midway between a first outer contact pad 108A and a second outer contact pad 108B in the set 106. The outer contact pads 108A, 108B are the nearest contact pads 108 to the respective first and second outer edges 126, 128 of the circuit card 104. In an embodiment, the guide frame centerline 220 aligns with the contact pad centerline 222, such that the centerlines 220, 222 are collinear. Thus, as the plug connector 100 is loaded into the slot 134 (shown in FIG. 2) of the receptacle connector 130 (FIG. 2), the outer walls 168 of the frame members 164 engage the respective end walls 144, 146 (FIG. 2) of the slot 134 to guide and position the circuit card 104 laterally such that the contact pads 108 of the circuit card 104 accurately align with the appropriate mating receptacle contacts 148 (FIG. 2).

In an exemplary embodiment, the contact pads 108 are located on the circuit card 104 independently of the outer edges 126, 128, and the guide frame 120 is mounted on the circuit card 104 independently of the outer edges 126, 128. Thus, the outer edges 126, 128 of the circuit card 104 do not factor into the alignment between the plug connector 100 and the receptacle connector 130 (shown in FIG. 2) during mating. For example, as shown in FIG. 6, the second outer edge 128 of the circuit card 104 is close to the inner wall 166 of the second frame member 164B, while the first outer edge 126 is further separated from the inner wall 166 of the first frame member 164A and is spaced apart by a gap 224. The width of the mating segment 178 of the circuit card 104 does not align laterally with the guide frame 120, as illustrated by a circuit card centerline 226 that is spaced apart from the guide frame centerline 220. The circuit card centerline 226 is midway between the outer edges 126, 128 of the circuit card 104. Also shown in FIG. 6, the first outer contact pad 108A is more proximate to the first outer edge 126 of the circuit card 104 than the distance separating the second outer contact pad 108B and the second outer edge 128. Thus, the circuit card centerline 226 is also spaced apart from the contact pad centerline 222. Since the contact pads 108 shown in FIG. 6 are positioned to accurately align with the mating receptacle contacts 148 (shown in FIG. 21 of the receptacle connector 130, if the set 106 of contact pads 108 would have been aligned with the outer edges 126, 128 (instead of with the at least one datum hole 190 shown in FIG. 4), the contact pads 108 would miss the appropriate receptacle contacts 148 during mating.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A plug connector comprising:

a circuit card held by a housing, the circuit card having a first surface and an opposite second surface, the circuit card including a front edge extending laterally between opposite outer edges of the circuit card, the circuit card defining at least one datum hole in the first surface, the circuit card further including a set of contact pads along the first surface proximate to the front edge, the contact pads being registered relative to the at least one datum hole; and a guide frame mounted to the circuit card, the guide frame having a base that has at least one post extending from a side thereof, the guide frame including a frame member that extends frontward from the base, an outer wall of the frame member being registered relative to the at least one post, the at least one post being received in the at least one datum hole of the circuit card such that the outer wall of the frame member is registered relative to the contact pads independent of locations of the outer edges of the circuit card, wherein the guide frame defines a mating segment of the circuit card that extends longitudinally from the base to the front edge of the circuit card, the set of contact pads disposed within the mating segment, the frame member extending frontward from the base proximate to a corresponding one of the outer edges of the circuit card along the mating segment and beyond the front edge of the circuit card, the corresponding outer edge located laterally between the outer wall of the frame member and the set of contact pads, wherein the frame member of the guide frame is configured to be received with the circuit card in a slot of a mating connector during a mating operation, the frame member configured to guide the circuit card into the slot to align the contact pads with corresponding mating contacts of the mating connector.

2. The plug connector of claim 1, wherein the at least one datum hole extends fully through the circuit card between the first and second surfaces, the base being mounted along the first surface, the guide frame further including a retention plate along the second surface, the retention plate including at least one retention hole receiving the at least one post of the guide frame protruding from the second surface to retain the guide frame on the circuit card.

3. The plug connector of claim 1, wherein the set of the contact pads along the first surface is a first set of contact pads, the circuit card further including a second set of contact pads along the second surface proximate to the front edge, the second set of contact pads being registered relative to the at least one datum hole.

4. The plug connector of claim 1, wherein the circuit card defines multiple datum holes and the guide frame includes multiple posts that are each configured to be received in a corresponding one of the datum holes.

5. The plug connector of claim 1, wherein the mating segment is configured to be received in a slot of a mating connector during a mating operation, the outer wall of the frame member along the mating segment configured to engage a respective end wall of the slot to guide the circuit card into the slot such that the set of contact pads align with corresponding mating contacts of the mating connector.

6. The plug connector of claim 1, wherein the set of contact pads along the first surface is a first set of contact pads and the circuit card further includes a second set of contact pads along the second surface, wherein the frame member of the guide frame is a first frame member extending frontward from the base proximate to a first outer edge of the outer edges of the circuit card along the mating segment and the guide frame further includes a second frame member extending frontward from the base proximate to an opposite, second outer edge of the outer edges of the circuit card along the mating segment, the first and second surfaces of the circuit card along the mating segment being exposed between the first and second frame members such that the first and second sets of contact pads can engage corresponding mating contacts of a mating connector.

7. The plug connector of claim 1, wherein the base has first and second ends, the frame member being a first frame member extending from the base at least proximate to the first end, and the base further including a second frame member extending from the base at least proximate to the second end.

8. The plug connector of claim 7, wherein the outer edges of the circuit card are disposed laterally between the outer wall of the first frame member and an outer wall of the second frame member such that a lateral width of the circuit card between the outer edges is less than a lateral width of the guide frame between the outer walls of the first and second frame members.

9. The plug connector of claim 7, wherein the first and second frame members have proximal ends at the base and distal ends away from the base, the distal ends of the first and second frame members being connected to each other via a ledge.

10. The plug connector of claim 7, wherein a guide frame centerline that is midway between the outer wall of the first frame member and an outer wall of the second frame member aligns with a contact pad centerline that is midway between outer contact pads in the set of contact pads independent of a location of a circuit card centerline that is midway between the outer edges of the circuit card.

11. A connector system comprising:

a plug connector including a circuit card held by a housing and a guide frame mounted to the circuit card, the circuit card including a front edge extending laterally between opposite first and second outer edges of the circuit card, the circuit card defining at least one datum hole through a first surface of the circuit card, the circuit card further including a set of contact pads along the first surface proximate to the front edge, the contact pads being registered relative to the at least one datum hole, wherein the guide frame of the plug connector has a base that includes at least one post, the guide frame further including a first frame member and a second frame member extending from the base to respective distal ends of the first and second frame members, the distal ends of the first and second frame members connected to each other via a ledge, the guide frame including a window defined laterally between the first and second frame members and longitudinally between the base and the ledge, respective outer walls of the first and second frame members being registered relative to the at least one post, wherein the at least one post is received in the at least one datum hole of the circuit card such that the outer walls of the frame members are registered relative to the contact pads, a mating segment of the circuit card including the set of contact pads disposed within the window of the guide frame, the first frame member extending along the first outer edge of the circuit card and the second frame member extending along the second outer edge of the circuit card such that a lateral width between the outer walls of the first and second frame members is greater than a lateral width of the circuit card between the first and second outer edges; and a receptacle connector having a receptacle housing that defines a slot at a mating end thereof, the receptacle connector holding multiple receptacle contacts along at least one of a first side wall or a second side wall, the slot defined between the first and second side walls and between first and second end walls, the first and second end walls extending between the first and second side walls;

wherein when the plug connector is mated to the receptacle connector, the first and second frame members of the guide frame are received within the slot and the respective outer walls of the first and second frame members engage the first and second end walls, respectively, of the slot to guide the set of contact pads on the circuit card into alignment with the corresponding receptacle contacts of the receptacle connector.

12. The connector system of claim 11, wherein the set of contact pads along the first surface is a first set of contact pads, the circuit card having a second surface opposite the first surface and further including a second set of contact pads along the second surface proximate to the front edge, the second set of contact pads being registered relative to the at least one datum hole, wherein the first set of contact pads is configured to align with and engage a first row of receptacle contacts held along the first side wall of the receptacle connector and the second set of contact pads is configured to align with and engage a second row of receptacle contacts held along the second side wall.

13. The connector system of claim 11, wherein the first and second frame members extend perpendicular to the at least one post.

14. The connector system of claim 11, wherein the at least one datum hole extends fully through the circuit card between the first surface and an opposite second surface, the base being mounted along the first surface, the guide frame further including a retention plate along the second surface, the retention plate including at least one retention hole receiving the at least one post of the guide frame protruding from the second surface to retain the guide frame on the circuit card.

15. The connector system of claim 11, wherein the circuit card defines multiple datum holes and the guide frame includes multiple posts that are each received in a corresponding one of the datum holes.

16. The connector system of claim 11, wherein the base has first and second ends, the first frame member extending from the base at least proximate to the first end, the second frame member extending from the base at least proximate to the second end.

17. The connector system of claim 11, wherein a guide frame centerline that is midway between the outer wall of the first frame member and an outer wall of the second frame member aligns with a contact pad centerline that is midway between outer contact pads in the set of contact pads independent of a location of a circuit card centerline that is midway between the outer edges of the circuit card.

18. The connector system of claim 11, wherein the ledge has a front edge and an opposite rear edge, the rear edge facing the base, wherein the front edge of the circuit card is disposed rearward of the rear edge of the ledge.

19. The connector system of claim 11, wherein the window extends fully through the guide frame.

20. A plug connector comprising:

a circuit card held by a housing, the circuit card having a first surface and an opposite second surface, the circuit card including a front edge extending laterally between opposite outer edges of the circuit card, the circuit card defining at least one datum hole in the first surface, the circuit card further including a first set of contact pads along the first surface and a second set of contact pads along the second surface, the first and second sets of contact pads disposed proximate to the front edge and registered relative to the at least one datum hole; and a guide frame mounted to the circuit card, the guide frame having a base that has at least one post extending from a side thereof, the base extending across a width of the circuit card between the outer edges, the guide frame including a first frame member and a second frame member that extend from the base to respective distal ends of the first and second frame members, the distal ends of the first and second frame members connected to each other via a ledge, the guide frame including a window defined laterally between the first and second frame members and longitudinally between the base and the ledge, respective outer walls of the first and second frame members being registered relative to the at least one post, wherein the at least one post is received in the at least one datum hole of the circuit card such that the outer walls of the first and second frame members are registered relative to the contact pads independent of locations of the outer edges of the circuit card, wherein the first and second sets of contact pads are disposed on a mating segment of the circuit card that extends longitudinally between the base and the front edge of the circuit card, the mating segment of the circuit card aligning within the window of the guide frame such that the first and second sets of contact pads are exposed through the guide frame for engaging corresponding mating contacts of a mating connector, the outer walls of the first and second frame member configured to be received in a slot of the mating connector to engage corresponding end walls of the slot to guide the mating segment of the circuit card into the slot such that the first and second sets of contact pads align with the corresponding mating contacts of the mating connector.

21. The plug connector of claim 20, wherein the first and second frame members of the guide frame are disposed laterally outward of the outer edges of the circuit card such that an inner wall of each of the first and second frame members faces a corresponding one of the outer edges of the circuit card, the inner walls of the first and second frame members spaced apart from the corresponding outer edges.

* * * * *